US010350123B2

(12) United States Patent
Wong et al.

(10) Patent No.: US 10,350,123 B2
(45) Date of Patent: Jul. 16, 2019

(54) LIFTING SLING DEVICE

(71) Applicant: U.S. Pacific Nonwovens Industry Limited, Kowloon (HK)

(72) Inventors: Cho Kee Wong, Kowloon (HK); Larry Clifton Wadsworth, Knoxville, TN (US)

(73) Assignee: U.S. PACIFIC NONWOVENS INDUSTRY LIMITED, Hong Kong (HK)

( * ) Notice: Subject to any disclaimer, the term of this patent is extended or adjusted under 35 U.S.C. 154(b) by 78 days.

(21) Appl. No.: 14/653,132

(22) PCT Filed: Feb. 18, 2013

(86) PCT No.: PCT/CN2013/071650
§ 371 (c)(1),
(2) Date: Jun. 17, 2015

(87) PCT Pub. No.: WO2014/124564
PCT Pub. Date: Aug. 21, 2014

(65) Prior Publication Data

US 2015/0342810 A1 Dec. 3, 2015

(51) Int. Cl.
*A61G 7/10* (2006.01)
*A61G 7/00* (2006.01)
*A61G 7/14* (2006.01)

(52) U.S. Cl.
CPC ..... *A61G 7/1023* (2013.01); *A61G 7/1051* (2013.01); *A61G 7/1061* (2013.01); *A61G 2200/34* (2013.01); *A61G 2203/90* (2013.01)

(58) Field of Classification Search
CPC ..... A61G 7/10; A61G 7/1023; A61G 7/1051; A61G 7/1061; A61G 2203/90; A61G 7/00; A61G 7/14
See application file for complete search history.

(56) References Cited

U.S. PATENT DOCUMENTS 4,712,257 A * 12/1987 James ..... A61G 7/1017 5/83.1
4,742,588 A * 5/1988 James ..... A61G 7/10 5/83.1
4,911,426 A * 3/1990 Scales ..... A61H 3/008 128/845

(Continued)

FOREIGN PATENT DOCUMENTS

CN 102675839 A 9/2012
CN 102727355 A 10/2012

OTHER PUBLICATIONS

International Search Report issued in corresponding International Application No. PCT/CN2013/071650, dated Nov. 21, 2013, 6 pages (with translation).

(Continued)

*Primary Examiner* — Nicholas F Polito
*Assistant Examiner* — Rahib T Zaman

(57) ABSTRACT

Disclosed is a lifting sling device. Fabric of a sling is made of a biodegradable non-woven polymeric material. Using the lifting sling device according to the present invention can not only avoid cross-infection due to use among different patients, but also can avoid a negative influence on the environment after the lifting sling device is discarded because the lifting sling device is biodegradable.

3 Claims, 1 Drawing Sheet

(56) References Cited

U.S. PATENT DOCUMENTS 5,190,533 A * 3/1993 Blackburn ..... A61F 13/15252 428/402
5,227,218 A * 7/1993 Herum ..... A61F 5/48 150/158
5,530,975 A * 7/1996 Firebaugh ..... A61G 7/1017 5/81.1 T
5,530,976 A * 7/1996 Horcher ..... A61G 7/1015 182/3
5,679,421 A * 10/1997 Brinton, Jr. ..... B32B 27/28 383/1
5,778,458 A * 7/1998 Speelman ..... A47K 11/105 4/451
6,035,465 A * 3/2000 Rogozinski ..... A61G 5/02 5/83.1
6,079,062 A * 6/2000 Mullin ..... A61G 7/1019 5/81.1 R
6,289,534 B1 * 9/2001 Hakamiun ..... A61G 7/1017 5/83.1
7,735,164 B1 * 6/2010 Patrick ..... A61G 7/1021 5/710
7,996,934 B2 * 8/2011 Hay ..... A61G 7/1019 5/81.1 R
8,572,774 B1 * 11/2013 Osika ..... A61H 1/0255 5/662
9,248,010 B2 * 2/2016 Li ..... A61F 2/0045 600/37
2003/0129908 A1 * 7/2003 Wadsworth ..... B32B 5/26 442/382
2005/0283907 A1 * 12/2005 Dalton ..... A61G 7/10 5/89.1
2006/0204727 A1 * 9/2006 Hino ..... B65D 65/466 428/195.1
2006/0246307 A1 * 11/2006 Chang ..... B32B 27/10 428/481
2009/0113623 A1 * 5/2009 Thomas ..... A61G 7/1023 5/89.1
2010/0287698 A1 * 11/2010 Stryker ..... A61G 5/1059 5/87.1
2012/0045604 A1 * 2/2012 Gavel ..... C09J 7/0282 428/41.8
2012/0210511 A1 * 8/2012 Davis ..... A61G 7/1028 5/81.1 R
2012/0304384 A1 * 12/2012 Scholz ..... A61G 7/1025 5/600
2013/0099547 A1 * 4/2013 McAdam ..... A47B 3/002 297/452.1
2013/0103079 A1 * 4/2013 Lau ..... A61L 17/08 606/229
2013/0115841 A1 * 5/2013 Ronner ..... D03D 15/0066 442/211
2015/0342811 A1 * 12/2015 Wong ..... A61G 7/1023 5/81.1 T

OTHER PUBLICATIONS

Written Opinion of the International Searching Authority issued in corresponding International Application No. PCT/CN2013/071650, dated Nov. 21, 2013, 7 pages (with translation).

* cited by examiner

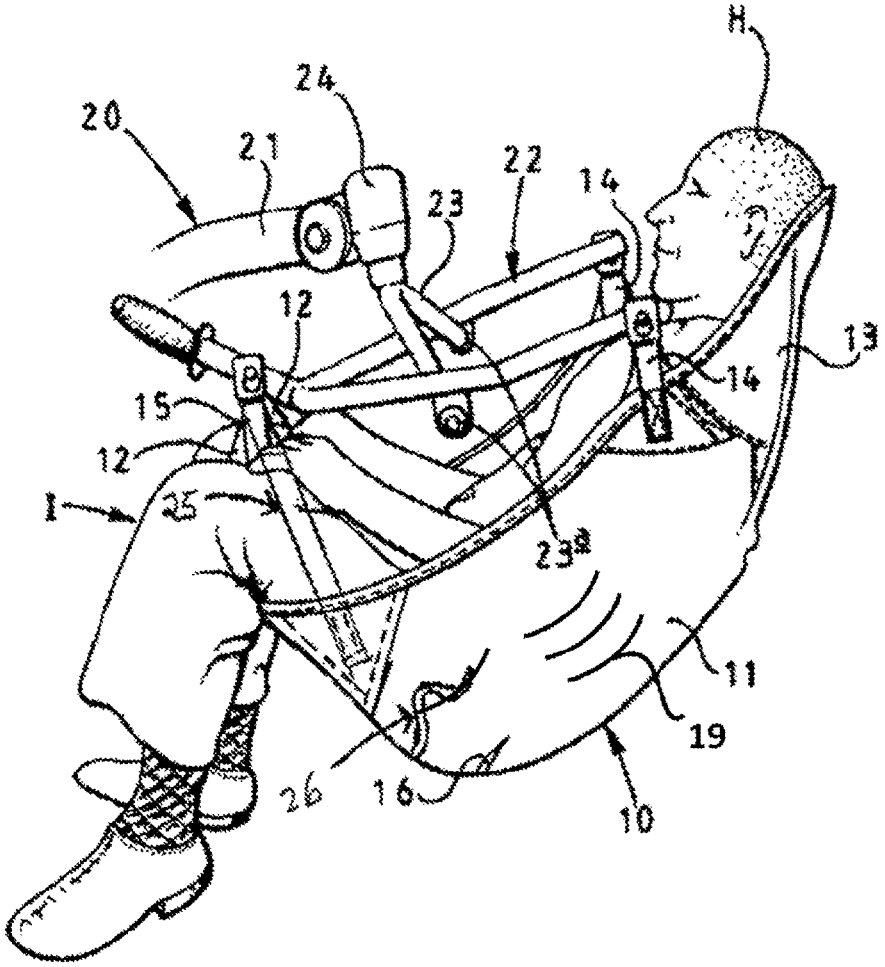
H
24
20
21
22
14
23
12
13
14
15
12
I
25
23a
11
19
26
16
10

LIFTING SLING DEVICE

FIELD OF THE INVENTION

The present invention relates to lifting devices, more particularly, relates to a lifting sling device.

BACKGROUND OF THE INVENTION

Lifting sling devices are always used to transport patients or disabled people. The critical issue in using lifting sling devices is how to prevent accident and cross-infection between patients. The earliest lifting sling device is made of woven fabrics, which is not only expensive but also easy to lead to cross-infection. CN 1184628 has disclosed a disposable or limited lifting device (corresponding to the lifting sling device here) made of nonwoven fabrics. As nonwoven fabrics are a fraction of the cost of woven fabrics and have the same carrying ability, it is possible to make the lifting device dedicated so as to prevent the risk of cross-infection. However, a new problem is derived that how to deal with the discarded lifting device. It is common to embed or incinerate the discarded lifting device, but the gas produced from the incinerating process may pollute environment and the landfill may also damage environment when the lifting device is not biodegradable.

Among the common biodegradable polymers today, the advantage of the polylactic acid (PLA) as biodegradable/compostable polymer for plastics and fibers is that although it is derived from natural, renewable materials, it is also thermoplastic and can be melt extruded to produce plastic items, fibers and fabrics with good mechanical strength, toughness, and pliability comparable to similar materials produced from a wide range of oil-based synthetics such as polyolefins (polyethylene and polypropylene) and polyesters (polyethylene terephthalate and polybutylene terephthalate). PLA is made from lactic acid, a fermentation byproduct derived from corn (*Zea mays*), wheat (*Triticum* spp.), rice (*Oryza sativa*), or sugar beets (*Beta vulgaris*). When polymerized, the lactic acid forms an aliphatic polyester with the dimmer repeat unit shown below:

(1)

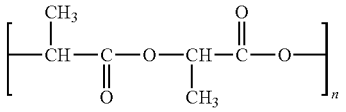

Poly(hydroxyalkonate)s [PHAs] have been found to be naturally synthesized by a variety of bacteria as an intracellular storage material of carbon and energy. The Copolyester Repeat Unit of P(3HB-co-4HB) of P(3HB-co-4HB) is as follows:

(2)

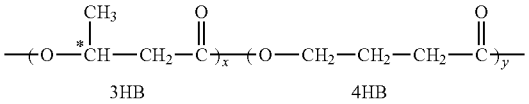

Polybutylene adipate terephthalate (PBAT) is a biodegradable polymer which is not currently produced from a bacteria source, but is synthesized from oil-based products. Although PBAT has a melting point of 120° C., which is lower than PLA, it has higher flexibility, excellent impact strength, and good melt processibility. Even though PLA has good melt processing, strength, and biodegradation/composting properties, it has low flexibility and low impact strength. Blending PBAT with PLA improves the end-product flexibility, pliability and impact strength. The chemical structure of PBAT is shown below:

(3)

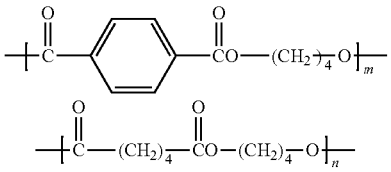

Poly(butylene succinate) (PBS) are synthesized by the polycondensation reactions of glycols. The chemical structure of PBS is shown below:

(4)

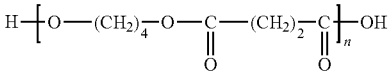

SUMMARY OF THE INVENTION

The objective of the present invention is to provide a biodegradable lifting sling device that has corresponding carrying ability and can prevent cross-infection between patients, aiming at the above-mentioned drawbacks that the discarded lifting devices may pollute environment in the prior art.

The technical solutions of the present invention for solving the technical problems are as follows: a lifting sling device is provided, which comprises a sling and a hoist, a patient in the sling can be lifted by the hoist, and the sling comprises a main portion used to support the body of the patient, the fabrics in the sling are biodegradable fabrics. In the present invention, the fabric in the sling is made of heat bonded randomly oriented biodegradable fibers.

In the present invention, the fabric in the sling is made of chemically bonded biodegradable fibers, the chemicals used comprise latex binders or adhesives.

In the present invention, the biodegradable fabric in the sling is made by hydroentangling or needlepunching.

In the present invention, the fabric in the main portion of the sling is made from nonwoven biodegradable polymeric material comprising PLA or blends of a major portion of PLA and a minor portion of PHA or of a major portion of PLA and minor portions of PHA and PBAT or of a major portion of PLA and minor portions of PHA, PBAT and PBS or of a major portion of PLA and minor portions of PBAT or PBS or of blends of PBAT and PBS.

In the present invention, an optional breathable or non-breathable biodegradable film is adhered to one or both faces of the fabric of the lifting sling device.

In the present invention, a biodegradable film is adhered to one or both sides of the main portion of the sling.

In the present invention, a biodegradable adhesive or biodegradable hot melt is used to adhere the biodegradable film to one or both sides of the main portion of the sling.

In the present invention, a biodegradable film is extrusion coated directly to one or both sides of the main portion of the sling without the need for adhesive.

In the present invention, the biodegradable film is made of materials comprising PBAT, PBS or blends of PBAT and PBS, blends of PBAT and PLA, blends of PBS and PLA, and blends of PBAT, PLA and PBS.

In the present invention, extension tapes are stitched to the lower end of the main portion 11 outside each of the legs of the invalid, and a belt loop is provided so that the extension tapes will be folded back and inserted through the belt loop when they are not used.

According to another aspect of the present invention, a method of preventing cross-infection between patients lifted in biodegradable body support slings is provided, where each patient has his/her own dedicated sling formed from biodegradable nonwoven material.

When implementing the present invention, the following advantageous effects can be achieved: when implementing the lifting sling device of the present invention, it is possible to prevent cross-infection between different patients resulting from re-use of sings among different patients, and it will not pollute the environment as the discarded lifting sling devices are biodegradable.

BRIEF DESCRIPTION OF THE DRAWINGS

The present invention will be further described with reference to the accompanying drawings and embodiments in the following, in the accompanying drawings:

FIG. 1 is a side perspective view of a lifting sling device and a patient according to an embodiment of the present invention.

DETAILED DESCRIPTION OF THE PREFERRED EMBODIMENT

To make the objects, technical schemes and advantages more clearly, the present invention may be further described in detail with reference to the accompanying drawings and embodiments. It should be understood that the preferred embodiments described here are illustrated but not limited.

The present invention relates to a body support lifting sling device, the fabric in the lifting sling device can be made of biodegradable polymers, which can prevent cross-infection between patients and can avoid polluting the environment after it has been discarded as it is biodegradable and/or compostable. Such slings support the back and thighs of a patient, being suspended from a hoist by detachable suspension means such as straps or the like.

The slings are, preferably, one piece body support slings which will support the back and thighs of a patient. At least a four point attachment of the suspension means will be required, with two attachment points at the sides of the sling in the shoulder region and two points at the bottom end of the sling between the legs of the patient. Two additional optional additional suspension means at the bottom of the sling with attachment points on each side of the sling on the outside of each leg of the patient, but preferable not close enough to touch the patient's leg during lifting may also be used to increase safety in lifting the patient and to give the patient a greater feeling of security. When the patient's legs are too wide, or are two tender or painful to risk any contact with the optional outside suspension means, the two optional suspension means will not be used and each suspension means will be folded back and inserted through a belt loop. The sling, advantageously comprises a main portion which supports the body of a person and lower end dependent leg portions which in use respectively extend beneath and upwardly beneath the thighs of the patient. The sling may also have an upper end head-support extension. In this case the sling may have two further attachment points at the head region or may have one or more reinforcements extending substantially throughout the extension and for a distance beyond a line joining the sling attachment points in the shoulder region of the sling.

The sling may be provided with darts or may be otherwise shaped so that it conforms more readily to the body shape of a person being lifted. It may also be reinforced and/or padded in regions.

FIG. 1 is a side perspective view of a lifting sling device and a patient according to an embodiment of the present invention. Referring to FIG. 1, there is shown therein a one-piece sling 10 comprising a main portion 11 with lower end dependent leg support portions 12 and an upper end head support extension 13. The main portion 11 supports the back and shoulders of a suspended invalid I with the portions 12 respectively extending beneath and up between the thighs of the invalid whose head H is supported by the head support extension 13. Short extension tapes 14 providing suspension means are stitched to the main portion 11 in the shoulder regions thereof and suspension tapes 15 are similarly stitched to the ends of the leg support portions 12. Further, optional extension tapes 25 are attached to the lower end of the main portion 11 outside each of the legs of the invalid I and secured at pivot 12. If extension tapes 25 are not used, they may be folded back through belt loop 26.

The sling 10 is, preferably, provided with an embossed pattern by rolling (calendering) to give it the appearance of a woven fabric. The sling 10 may be reinforced by an additional layer of fabric in regions where the suspension tapes 14, 15 and optional suspension tapes 25, are stitched to the sling and the leg portions 12 may have padding between two layers of the nonwoven fabric lifting arm is shown, and to increase comfort for the invalid. These slings can be made at a fraction of the cost of woven slings and are intended as disposable or limited use slings which are dedicated to individual persons to avoid the risk of cross-infection.

In order to support the head support extension 13, the sling may have one or more reinforcements extending substantially throughout the extension 13 and for a distance along the line joining to the points where the extension tapes 14 are stitched to the main portion 11. Alternatively, two further suspension tapes (not shown) may be connected to the head region.

Referring to FIG. 1, the body support lifting sling device further comprises a hoist 20, only the outer end of the lifting arm 21 is shown, and a hanger 22 is connected to the arm through a forked connection, the connection 23 is mounted in a bearing 24 providing a vertical pivot axis at the end of the arm 21, and it is pivotally connected to the hanger 22 at points 23*a*. The arrangement is such that the hanger 22 can turn about the rigid vertical axis at the outer end of arm 21, and the hanger 22 and the connection 23 can turn about the vertical axis as a whole, with the hanger 22 and the connection 23 turning about a traverse horizontal axis defined by the pivot points 23*a*.

A sling as described herein has been subjected to fifty lifts lifting 250 kg and a further fifty lifts lifting 190 kg and has withstood this test without any sign of weakening.

Ideally, it should not be possible to launder the slings. This will avoid re-use among different patients. To this end, it is envisioned that the seams may be secured, and the suspension tapes attached to the sling, by a soluble thread so that the slings will fall apart if laundering is attempted.

The present invention is not limited to one-piece lifting sling devices, but may also be applied to other lifting sling devices. Also, one-piece lifting sling devices are not always provided with a head extension 13.

Furthermore, a breathable or non-breathable film can be laminated to either or both sides of the biodegradable nonwoven fabric of the sling to contain any body fluids of the patient during lifting and transport.

In order to prevent the discarded lifting sling devices make bad effect on the environment, the fabric in the lifting sling device can be made from biodegradable and/or compostable fabrics. The biodegradable and/or compostable fabrics will be discussed below. The biodegradable materials used in the present invention can ensure the corresponding carrying ability of the sling to avoid accidents in lifting; at the same time, the manufacturing cost will not be increased so that the patients can afford the dedicated lifting sling devices to avoid cross-infection.

Although the biodegradation of P(3HB-co-4HB) products have been shown to readily occur in soil, sludge, and sea water, the rate of biodegradation in water in the absence of microorganisms is very slow (Saito, Yuji, Shigeo Nakamura, Masaya Hiramitsu and Yoshiharu Doi, "Microbial Synthesis and Properties of Poly(3-hydroxybutyrate-co-4-hydroxybutyrate)," Polymer International 39 (1996), 169-174). Thus the shelf life of P(3HB-co-4HB) products in clean environments such as dry storage in sealed packages, in clean wipes cleansing solution, etc should be very good. However when placed in dirty environments containing microorganisms such as soil, river water, river mud, sea water, and composts of manure and sand, sludge and sea water, the disposed P(3HB-co-4HB) fabrics, films and packaging materials should readily degrade. It should be noted that polylactic acid (PLA) is not considered to be readily biodegradable in the above dirty environments and ambient temperature, but must be composted. First the heat and moisture in the compost pile must break the PLA polymer into smaller polymer chains and finally to lactic acid. Then microorganisms in the compost and soil consume the smaller polymer fragments and lactic acid as nutrients. Thus the mixing of polyhydroxyalkonates (PHAs) as such as P(3HB-co-4HB) with PLA should enhance the biodegradation of products made from blends of PHAs-PLA. Furthermore, products made from blends of PHAs and PLA should have enhanced shelf-life in clean environments. However, the price of PLA has decreased substantially over the past 10 years to just a little more than synthetic polymers such as polypropylene and PET polyester; whereas, the price of PHAs will likely remain two to three times higher than PLA which is synthesized on a large scale from lactic acid. PHAs are produced by bacteria with specific carbon sources, and have to be extracted from the bacteria with a solvent. Thus it may not be commercially feasible to mix more than 25% PHA with PLA to melt extrude products such as fibers of woven, knitted and nonwoven fabrics, films, food packaging containers, etc.

Examples of biodegradable nonwoven fabric, biodegradable films, and nonwovens laminated with biodegradable films are shown in Table 1. Pure PBAT film with a thickness of 9 micron (μm) and 9 μm PBAT film with 20% calcium carbonate were obtained from a vendor in China. Meltblown (MB) Vistamaxx® (not biodegradable) containing 20% PP (not biodegradable) was obtained from the Biax-Fiberfilm Corporation in Neenah, Wis., USA. Spunbond (SB) PLA pigmented black with carbon black with a nominal weight of 80 g/m2 was obtained from the Saxon Textile Research Institute in Germany. The pure PBAT film and PBAT film with 20% calcium carbonate were laminated in separate trials to Vistamaxx MB containing 20% PP and black SB PLA using from 5-13 g/m2 of hot-melt adhesive. Generally from 0.5-12 g/m2 hot-melt adhesive and preferably from 1-7 g/m2 of hot-melt adhesive should be used. In addition, two layers of the SB PLA were laminated and adhered using hot-melt adhesive. All of the raw materials and laminates were tested as shown in Table 1 for weight, thickness, tenacity, elongation-to-break, tearing strength, bursting strength, water vapor transmission rate (WVT) and hydrohead. It should be noted that these are only some examples of the different embodiments of this invention and that in addition to using a hot-melt application to adhere the different layers of the materials below together, the PBAT films or other biodegradable/compostable films could be directly applied to the substrates by extrusion coating without necessarily requiring an adhesive. The laminate could have been joined or bonded together by thermal point calendaring, overall-calendering, or ultra-sonic welding, just to name a few. Furthermore, instead of a hot-melt adhesive, glue, or water or solvent-based adhesives or latexes could have been used to adhere the laminates together.

TABLE 1

Strength and Barrier Properties of Polymers

| Sample No./ | Weight | Thick | Tenacity N/5 cm | | Elongation % | | Tear Strength Trapzoid, N | | Burst Strength | WVTR | Hydrohead |
|---|---|---|---|---|---|---|---|---|---|---|---|
| Description | $g/m^2$ | mm | MD | CD | MD | CD | MD | CD | $KN/m^2$ | $g/m^2$ 24 hr | mm $H_2O$ |
| 1/Pure PBAT Film, 9 μm | 8.9 | 0.009 | 10.0 | 5.1 | 67.7 | 307.6 | 1.5 | 14.6 | *DNB | 3380 | 549 |
| 2/PBAT Film with 20% $CaCO_3$ | 9.3 | 0.010 | 8.9 | 4.1 | 48.1 | 296.3 | 1.8 | 8.0 | DNB | 2803 | 415 |
| 3/MB Vistamaxx & 20% PP | 42.1 | 0.229 | 17.2 | 11.6 | 304.0 | 295.8 | 16.0 | 8.6 | DNB | 8816 | 1043 |
| 4/PBAT Film + Vistamaxx | 63.9 | 0.242 | 31.4 | 16.0 | 179.5 | 390.0 | 24.6 | 8.5 | DNB | 1671 | 339 |
| 5/PBAT Film + 20% $CaCO_3$ + Vistamaxx | 65.3 | 0.249 | 25 | 17.7 | 116.6 | 541.9 | 22.0 | 10 | DNB | 1189 | 926 |
| 6/Black 80 gsm | 81.3 | 0.580 | 102.4 | 30.7 | 3.6 | 30.7 | 6.2 | 12.0 | 177 | 8322 | 109 |

TABLE 1-continued

Strength and Barrier Properties of Polymers

| Sample No./ Description | Weight g/m² | Thick mm | Tenacity N/5 cm MD | Tenacity N/5 cm CD | Elongation % MD | Elongation % CD | Tear Strength Trapzoid, N MD | Tear Strength Trapzoid, N CD | Burst Strength KN/m² | WVTR g/m² 24 hr | Hydrohead mm $H_2O$ |
|---|---|---|---|---|---|---|---|---|---|---|---|
| SB PLA 7/Black 80 gsm SB PLA + Pure PBAT Film | 101.3 | 0.584 | 107.0 | 39.2 | 4.6 | 9.8 | 8.5 | 20.7 | 220 | 2459 | 3115 |
| 8/Black 80 gsm SB PLA + PBAT Film-20% $CaCO_3$ | 96.5 | 0.557 | 97.0 | 36.3 | 4.9 | 8.0 | 9.3 | 19.0 | 151 | 2353 | 2600 |
| 9/2 Layers of Black SB PLA Bonded by 3 gsm hot-Melt | 183.6 | 1.060 | 215.3 | 76.8 | 4.9 | 9.4 | 14.7 | 22.5 | 503 | 7886 | 70 |

*DNB—Did not burst due to high elasticity

As shown in Table 1, the 9 μm pure (100%) PBAT film (Sample 1) had good elongation in the MD direction and very high elongation-at-break of over 300% in the CD. The bursting strength test could not be performed on Samples 1 through 5 because all of these samples were so elastic that the films and laminates did not rupture during the test and appeared not to be distorted after the test. The water vapor transfer rate of Sample 1 was rather good at 3380 g/m2/24 hours as was the hydrostatic head at 549 mm. The PBAT film containing 20% calcium carbonate (CaCO3) (Sample 2) had similar properties as Sample 1 with both the WVTR and hydrohead being a little lower. PBAT films similar to Samples 1 and 2 with a smaller thickness of 6 μm or less would also be expected to have good elongation and higher WVTR, although the hydrohead may be lower. The melt-blown (MB) Sample 3, containing 80% Vistamaxx® (Vistamaxx polyolefin-based polymer is highly elastic and is produced by ExxonMobil) and 20% PP had a very high MD and CD elongation of about 300% and a very high WVTR of 8816 g/m2/24 hours since the fabric is fairly open. Although the MB Vistamaxx fabric is not biodegradable, it is an example of an elastic nonwoven which could potentially be made from a biodegraqdable polymer, such as PBAT and other biodegradable polymers with very high elongation and recovery from deformation. The hydrohead of Sample 3 was rather high at 1043 mm, which indicated it still had good barrier properties. It should be noted that 20% PP was added to the Vistamaxx polymer pellets and physically mixed before the blend was fed into the MB extruder and melted so that the Vistamaxx MB fabric would not be too sticky. If 100% Vistamaxx was meltblown, it would be very sticky and may block on the roll and be difficult to un-wind for lamination or use later.

The lamination of the pure PBAT and PBAT containing 20% CaCO3 with Vistamaxx using a hot-melt adhesive notably increased the MD and CD tenacity compared to Vistamaxx alone. The samples also had very high MB elongation and particularly high CD elongation (390% with Sample 4 and 542% with Sample 5). Also Samples 4 and 5 had notably high MVTR values of 1671 and 1189 g/m2/24 hours and high hydroheads of 339 and 926 mm H2O, respectively. Again it should be noted that the PBAT films could have been extrusion-coated directly onto MB 100% Vistamaxx or onto MB Vistamaxx with some PP with or without the use of a hot-melt adhesive and the extrusion-coating process could have allowed a much thinner gauge of PBAT film to be used, possibly as low as 4 or 5 μm, with a resulting higher MVTR, but with possibly lower hydrohead.

The black SB PLA with a target weight of 80 g/m2, had a MD tenacity of 104 N and a CD tenacity of 31 N, but with a lower MD elongation-at-break of 3.6% but high CD elongation of 30.7%. The busting strength was 177 KN/m2 and the WVTR was rather high at 8322 g/m2/24 hours and the hydrohead was notable at 109 mm. The MD and CD tenacity of the 80 gsm black SB PLA, which was laminated to pure PBAT with hot-melt adhesive, were higher than with the SB PLA alone at 107 and 39 N, respectively, but the CD elongation was only 9.8%. However, the PBAT laminated SB PLA had higher burst strength at 220 KN/m2. The breathability was still good with a WVTR of 2459 g/m2/24 hours and a very high hydrohead of 3115 mm H2O. The SB PLA laminated with PBAT containing 20% CaCO3 had similar properties to Sample 8, except that the hydrohead, although still high at 2600 mm H2O, was lower. The lamination of SB PLA with thinner PBAT films, and especially with thinner PBAT films deposited by extrusion coating, produces protective apparel for medical, industrial or sports applications with high MVTR for wearing comfort and high hydrostatic head for barrier protection. The barrier protection could be further enhanced by the application of a repellent finish (fluorochemical silicone or other types of repellent finishes) to either the PBAT film side or to the SB PLA on either side before or after lamination with the film. Another enhancement would be the lamination of MB PLA with SB PLA before or after lamination with the film. The repellent finishing agent could also possibly be added to the polymer melt used to produce the PBAT film, SB or MB PLA, for example.

When two layers of SB PLA were melt-adhesively bonded together to produce Sample 9, the MD and CD tenacity and bursting strength were essentially twice one layer, Sample 6. The target MD and CD tenacity and corresponding elongation-to-break (% elongation) values of patient lifting sling devices produced from 110 g/m2 SB PP are at least 200 and 140 N/5 cm, respectively, with elongation values of at least 40% in both MD and CD. As shown in Table 1, the MD tenacity of the two adhered layers of SB PLA is 215 N but the CD tenacity is only about 50% of the required level. Also the MD and CD % elongation values are much lower than the required minimum of 40%. The MD and CD elongation of SB PLA can be improved by blending from 5 to 60% PBAT and preferably 20-50% PBAT with the PLA prior to extrusion of the SB fabrics. Furthermore, PBAT and PBS may be blended with PLA to achieve fabric with the desired MD and CD tenacity and elongation values, as well as stability to heat exposure. Furthermore, the SB filament web may be bonded by processes other than thermal point calendaring to achieve greater multi-directional strength and elongation to include hydroentanglement and needlepunching. Needlepunched SB PLA can be produced at weights or 110 g/m2 and greater without the need to laminate and bond two or more SB PLA fabrics together to achieve the required strength and elongation values.

It has also been shown that the slings made with biodegradable/compostable fabrics such as PLA produce much lower greenhouse gas emissions, such as carbon dioxide, from cradle (raw materials stage) to polymer at the factory. For example, the production PLA polymer produces 1.3 kg CO2/kg polymer compared to 1.9 kg CO2/kg polymer with PP and 3.4 kg CO2/kg polymer with PET. Also PLA uses much less non-renewable energy from cradle to polymer factory in that Ingeo PLA uses 42 MJ/kg polymer compared to PP with 77 MJ/kg polymer and PET with 87 MJ/kg polymer ("The Ingeo™ Journey, NatureWorks LLC Brochure Copyright 2009).

The sling is made of nonwoven biodegradable/compostable polymeric material, typically PLA or blends of a major portion of PLA and a minor portion of PHA or of a major portion of PLA and minor portions of PHA and PBAT or of a major portion of PLA and minor portions of PHA, PBAT and PBS or of a major portion of PLA and minor portions of PBAT or PBS or of blends of PBAT and PBS. The sling is tailored to conform more closely to the shape of the invalid I and thus provide increased comfort for the later. To this end, darts 16 are provided in the sling 10.

Typically, the sling is made by heat bonding randomly oriented biodegradable/compostable polymer fibers, but it could be made of drylaid, chemically bonded (with biodegradable adhesive) fabric or of drylaid, spunlace (hydroentangled) fabric. This material does breathe (unless a non-breathable biodegradable film is adhered to it) but does not pass water and it may necessary to provide perforations in the sling if it is to be used for lowering invalids into a bath.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

The invention claimed is:

1. A lifting sling device comprises a sling and a hoist, wherein a patient in the sling is lifted by the hoist, and the sling comprises a main portion with a lower end dependent leg support portions and an upper end head extension to support a body of the patient, wherein, the sling is made of fabrics, and the fabrics in the sling are biodegradable fabrics;

wherein, the hoist comprises a lifting arm, a hanger, a connection and a bearing, the hanger is connected to the lifting arm through a forked connection, the connection is mounted in the bearing providing a vertical pivot axis at the end of the lifting arm;

wherein, the fabric in the sling is made of chemically bonded biodegradable fibers or heated bonded randomly oriented biodegradable fibers, and the chemically bonded biodegradable fibers used comprise latex binders or adhesives;

wherein, the fabric in the main portion of the sling is made from nonwoven biodegradable polymeric material comprising blends of a major portion of PLA and a minor portions of PHA, PBAT and PBS or of a major portion of PLA and minor portions of PBAT or PBS or of blends of PBAT and PBS;

wherein a breathable or non-breathable biodegradable film is adhered to the fabric of the lifting sling device;

wherein said biodegradable film is adhered to the main portion of the sling;

wherein said biodegradable film is adhered to the main portion of the sling via biodegradable adhesive or biodegradable hot melt or is extrusion coated directly to the main portion of the sling;

wherein the biodegradable film is made of materials comprising PBAT, PBS or blends of PBAT and PBS, blends of PBAT and PLA, blends of PBS and PLA, and blends of PBAT, PLA and PBS.

2. The lifting sling device of claim 1, wherein, the biodegradable fabric in the sling is made by hydroentangling or needlepunching.

3. The lifting sling device of claim 1, wherein, extension tapes are stitched to the lower end of the main portion outside each of legs of the patient, and a belt loop is provided so that the extension tapes are folded back and inserted through the belt loop when they are not used.

* * * * *